US007306176B1

(12) United States Patent
Prince

(10) Patent No.: US 7,306,176 B1
(45) Date of Patent: Dec. 11, 2007

(54) COMPRESSION ASSEMBLY

(75) Inventor: Jesse Jewell Prince, Gainesville, GA (US)

(73) Assignee: Prince Industries, Inc., Murrayville, GA (US)

( * ) Notice: Subject to any disclaimer, the term of this patent is extended or adjusted under 35 U.S.C. 154(b) by 554 days.

(21) Appl. No.: 10/872,913

(22) Filed: Jun. 21, 2004

(51) Int. Cl.
*B02C 18/30* (2006.01)

(52) U.S. Cl. ..... 241/74; 241/82.5

(58) Field of Classification Search ..... 241/74, 241/82.1–82.7, 79; 452/138
See application file for complete search history.

(56) References Cited

U.S. PATENT DOCUMENTS

| | | | | |
|---|---|---|---|---|
| 3,612,130 | A | 10/1971 | Ponka et al. | |
| 3,631,981 | A | 1/1972 | Young | |
| 3,797,763 | A | 3/1974 | Handle et al. | |
| 3,823,882 | A | 7/1974 | Jensen | |
| 3,984,056 | A | 10/1976 | Hartley | |
| 4,157,966 | A | 6/1979 | Hassall | |
| 4,529,520 | A | 7/1985 | Lampenius | |
| 4,885,090 | A | 12/1989 | Chupka et al. | |
| 4,928,892 | A * | 5/1990 | Huebner et al. | 241/82.5 |
| 4,986,900 | A | 1/1991 | Mason | |
| 5,023,986 | A | 6/1991 | Gero et al. | |
| 5,059,324 | A | 10/1991 | Chen | |
| 5,073,254 | A | 12/1991 | Beisenherz et al. | |
| 5,251,829 | A | 10/1993 | Lesar | |
| 5,259,512 | A | 11/1993 | Czerwoniak | |
| 5,289,979 | A | 3/1994 | Lesar | |
| 5,344,086 | A | 9/1994 | Lesar | |
| 5,443,214 | A | 8/1995 | Lesar | |
| 5,513,757 | A | 5/1996 | Papetti | |
| 5,944,267 | A | 8/1999 | Haack et al. | |
| 5,954,956 | A | 9/1999 | Lutz et al. | |
| 6,138,838 | A | 10/2000 | Soik et al. | |
| 6,257,413 | B1 | 7/2001 | Tolvanen | |
| 6,338,412 | B1 | 1/2002 | Serres et al. | |
| 6,622,950 | B1 | 9/2003 | Fleming et al. | |
| 2001/0020655 | A1 | 9/2001 | Vomhof et al. | |
| 2002/0084368 | A1 | 7/2002 | Bernhardt et al. | |

FOREIGN PATENT DOCUMENTS

| | | |
|---|---|---|
| DE | 003522202.1 | 2/1987 |
| DE | 253367 | 1/1988 |
| GB | 2144056 | 2/1985 |
| WO | WO 93/04797 | 3/1993 |

* cited by examiner

*Primary Examiner*—Mark Rosenbaum
(74) *Attorney, Agent, or Firm*—Kilpatrick Stockton LLP

(57) ABSTRACT

Devices, assemblies, and compression members for regulating the pressure or dwell time within separating machines that separate hard material from soft material are disclosed. The device utilizes a compression assembly comprising a compression member, a base member, a primary key, a primary key receptor, a secondary key, and a secondary key receptor for controlling the amount of material that is forced through a conduit. The primary key, the primary key receptor, the secondary key, and the secondary key receptor secure the compression member to the base member. The devices, assemblies, and compression members of the present invention regulate the pressure exerted on the separating machine by the compressed hard and soft materials and also regulate the dwell time of the hard and soft materials within the separating machine in a manner that reduces the difficulty, expense, and associated time of replacing worn compression members.

14 Claims, 4 Drawing Sheets

COMPRESSION ASSEMBLY

RELATED FIELDS

This invention relates to machinery for the separation of hard material (bone, shell, etc.) from soft material (flesh, meat, pulp, juice, oil, etc.) of land and sea animals, fruits and or vegetables. Specifically, this invention relates to structures that control the ratio of hard material and soft material produced.

BACKGROUND

Conventional separating machinery utilizes an auger or piston to pressurize the material to be separated through a screen or sieve, so that the soft material (flesh, meat, pulp juice, oil, etc.) passes through the screen or sieve, and the hard material does not or does so only in very small controlled quantities.

Such machines use an adjustment mechanism to control the separation process by regulating the pressure and or dwell time within the specified machine. The adjustable mechanism consists of a ring, sometimes referred to as a compression ring, having an inwardly tapered leading edge, adjacent to a correspondingly tapered ramp on the pressure device (auger, piston, belt, etc.) The position of this adjustable ring can be controlled to create a larger or smaller opening as desired between the ring and the corresponding surface on the auger, piston, belt, etc.

Rings, or structures associated with the rings, may include external threads that engage a worm drive to move the ring closer to or farther away from the auger surface. The spacing between such a ring and the sloping auger, piston, belt, etc. is conventionally controlled manually using a ratchet style mechanism, a hand wheel, a wrench, hydraulics, or combinations of such means. Each alternative has associated drawbacks. Regardless of which method is utilized, each change in the setting-opening is accompanied by a change in the size of the "window" afforded for evacuation of the hard materials, further aggravating the expulsion and removal of the hard materials and thereby increasing pressure within the machine, increasing temperature through pressure and friction thereby increasing component wear.

Because rings typically wear at a high rate, they must be replaced periodically. However, because of the expense associated with machining the rings, typically, only a portion of the ring is replaced. Typically, a base portion of the ring, which may include the above mentioned threads and other structure, is secured using nuts and bolts to the ring portion, which typically wears much more quickly. Such an assembly, however, may be undesirable because the nuts and bolts may be lost during cleaning of the components. Additionally, removing all the nuts to allow the ring's removal is relatively time consuming. Moreover, sometimes the nuts may "freeze" to the bolts, requiring the nuts to be sawn off to allow ring removal. The bolts, as well as the holes that allow the bolts to extend through the components, may define weak areas that are susceptible to cracking, shearing or breaking. Finally, securing the ring to the base using bolts may be problematic in that it causes difficulty in aligning the ring to the base.

Additionally, typical compression assemblies do not allow for liquid material to escape from outside the ring; such material gets trapped in the base and creates maintenance problems. When the liquid builds up, it can solidify, freezing the ring to the machine and preventing removal and/or adjustment of the ring.

SUMMARY

Various embodiments of the present invention include devices, assemblies, and compression members for regulating the pressure or dwell time within separating machines that separate hard material from soft material. Such devices may include a conduit, an inlet connected to the conduit for providing hard and soft material to the conduit, a separating apparatus positioned at one end of the conduit, and a compression assembly for controlling the amount of material that is forced through the conduit. In certain embodiments, the compression assembly includes a compression member with a compression member aperture, a base member with a base member primary aperture, a primary key, a primary key receptor, a secondary key, and a secondary key receptor. The primary key, the primary key receptor, the secondary key, and the secondary key receptor secure the compression member to the base member. In certain embodiments, the compression member comprises a first compression member surface, a second compression member surface, an exterior compression member surface, and an interior compression member surface, the interior compression member surface extending from the first compression member surface to the second compression member surface in a manner not substantially perpendicular to either the first compression member surface or the second compression member surface, the compression member being adapted to be detachably attached to a base member by a primary key, a primary key receptor, a secondary key, and a secondary key receptor. Devices, assemblies, and compression members according to embodiments of the present invention regulate the pressure exerted on the separating machine by the compressed hard and soft materials and also regulate the dwell time of the hard and soft materials within the separating machine in a manner that reduces the difficulty, expense, and associated time of replacing worn compression members.

BRIEF DESCRIPTION

DETAILED DESCRIPTION

Embodiments of the present invention include devices, assemblies, and compression members for separating hard material from soft material. Reference will now be made in detail to exemplary embodiments of the invention as illustrated in the text and accompanying drawings. Those skilled in the art will recognize that many other implementations are possible, consistent with the present invention. The same reference numbers are used throughout the drawings and the following description to refer to the same or like parts.

Figure 1:
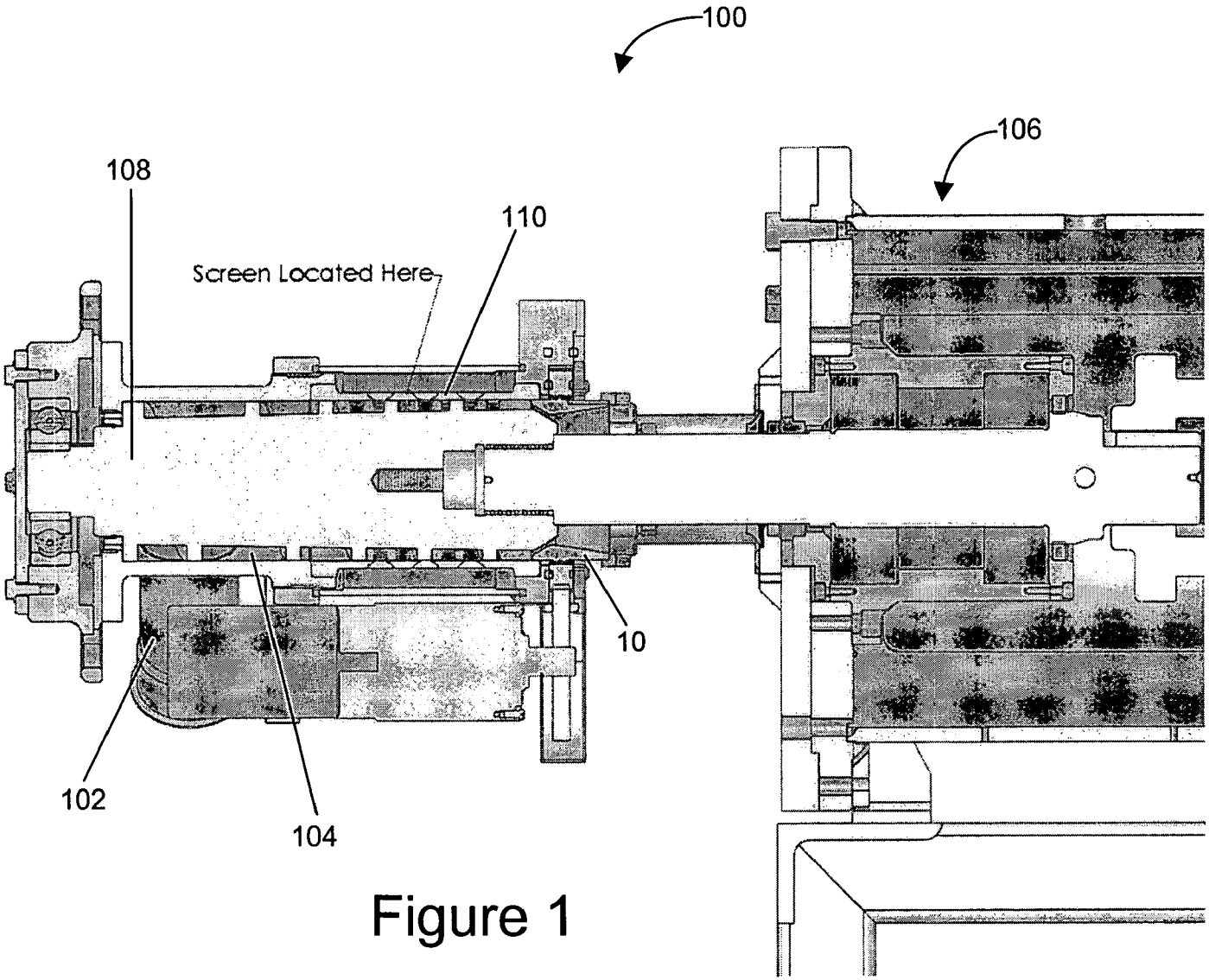
FIG. 1 shows a cross-sectional schematic view of a separating machine according to a first embodiment of the present invention.
Figure 2:
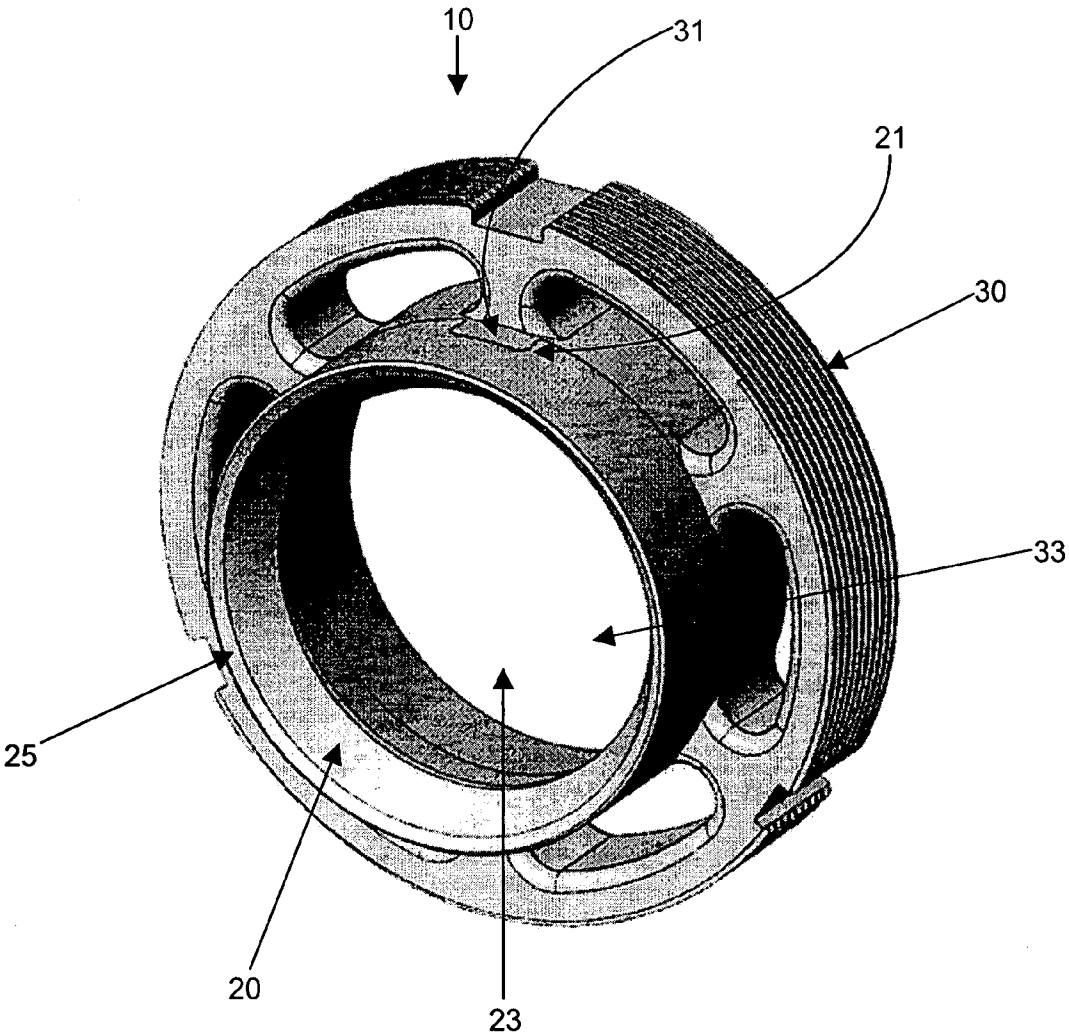
FIG. 2 shows an assembled compression assembly according to another embodiment of the present invention.

FIG. 1 illustrates a cross-sectional view of an example of a separation machine 100 utilizing an embodiment of the compression assembly 10 (shown in FIG. 2). The material that undergoes separation in this separation machine 100 is, for example, animal parts, shellfish, fruits, or vegetables.

The material enters the machine through the inlet tube 102 and passes from the inlet tube 102 to the conduit 108. Opposite the inlet tube 102 at the other end of the conduit 108 is a screen 110. A motor assembly 106 drives an auger 104 that causes the material to flow from the inlet tube 102 through the conduit 108 toward the screen 110. As material builds up in the screen end of the conduit 108, the pressure increases and forces the soft material through the apertures in the screen 110. The soft material then exits the separation machine 100 through an outlet tube (not shown). The compression assembly 10 is positioned relative to the auger 104 so as to achieve a desired pressure and thereby control the amount of hard material that is separated from the soft material. The hard material discharges from the separation machine 100 through the space between the auger 104 and the compression assembly 10. The separation machine 100 illustrated in FIG. 1 is a reverse flow type machine in which the material flows toward the motor assembly 106. As is well known to those skilled in the art, the separation machine 100 could alternatively be a forward flow machine in which the material flows away from the motor assembly 106. As is also well known to those skilled in the art, separation machine 100 may also use other devices and methods, such as a piston, belts, or the like, to move the material through the conduit 108.

FIG. 2 illustrates one embodiment of a compression assembly 10 of the present invention. As shown in FIG. 2, the compression assembly 10 includes two parts, one part being a compression member 20 and one part being a base member 30. The compression member 20 detachably attaches to the base member 30 through the interaction of at least one primary key 31 extending from the base member 30 and at least one corresponding primary key receptor 21 recessing into the compression member 20, and through the interaction of at least one secondary key 32 (shown on FIG. 4) extending from the base member 30 and at least one corresponding secondary key receptor 22 (shown on FIG. 4) recessing into the compression member 20. The compression member 20 defines a compression member aperture 23 and the base member 30 defines a base member primary aperture 33, at least a portion of which aligns with at least a portion of the compression member aperture 23 to permit flow of material through the at least partially aligned apertures. Other arrangements of the at least one primary key 31, at least one corresponding primary key receptor 21, at least one secondary key 32, and at least one corresponding secondary key receptor 22 are possible. For example, the primary key and secondary key may be located on the base and the respective corresponding primary key receptor and second key receptor located on the compression member.

Figure 3:
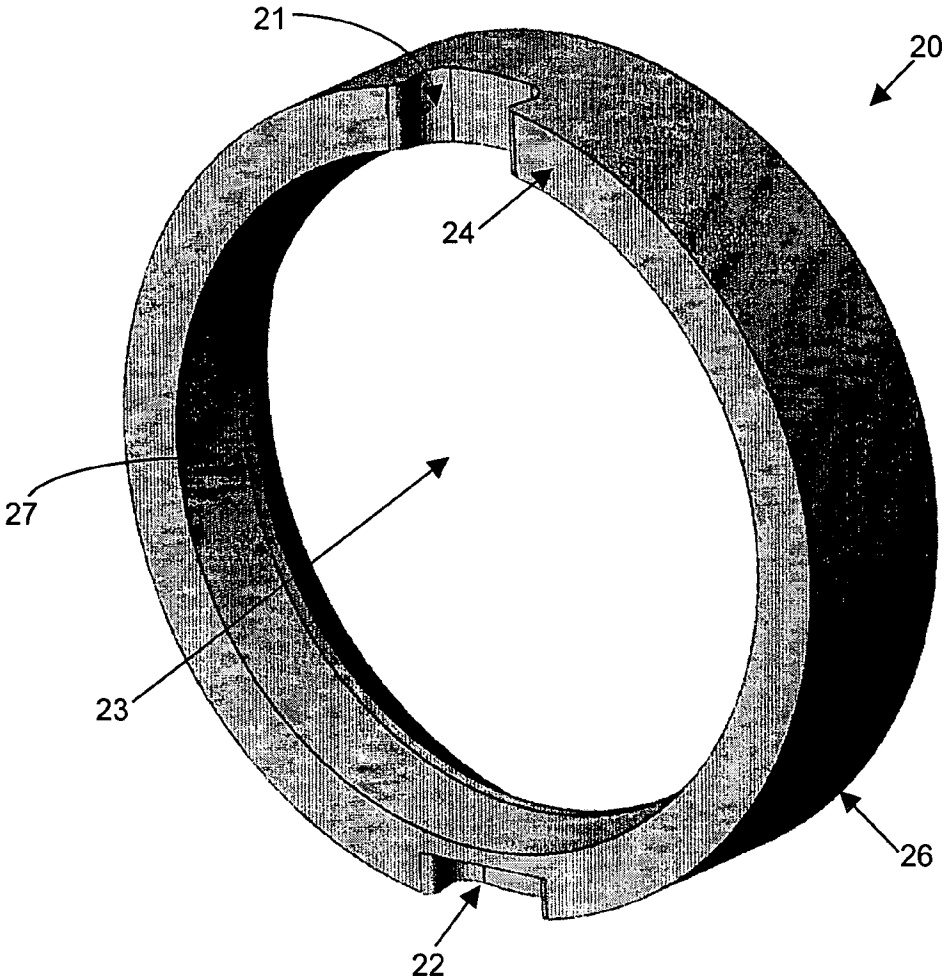
FIG. 3 shows the compression member of FIG. 2 disassembled from the compression assembly of FIG. 2.

FIG. 3 shows a compression member 20 according to various embodiments of the present invention. The compression member 20 shown in FIG. 3 is generally cylindrical in shape, having a first compression member surface 24, a second compression member surface 25 (shown on FIG. 2), an exterior compression member surface 26, and an interior compression member surface 27, which is not substantially perpendicular to either the first compression member surface 24 or the second compression member surface 25. The interior compression member surface 27 defines the compression member aperture 23.

The primary key receptor 21 is a first indentation that extends from the exterior compression member surface 26 to and through the interior compression member surface 27 and that recesses from the first compression member surface 24 toward the second compression member surface 25 without recessing all the way to or through the second compression member surface 25. The secondary key receptor 22 is a second indentation that extends from the exterior compression member surface 26 toward the interior compression member surface 27 but does not extend all the way to or through the interior compression member surface 27 and that recesses from the first compression member surface 24 toward the second compression member surface 25 without recessing all the way to or through the second compression member surface. The primary key receptor 21 and the secondary key receptor 22 are each shaped such that the interaction of the primary key 31 (shown on FIG. 4) with the primary key receptor 21 and the interaction of the secondary key 32 (shown on FIG. 4) with the secondary key receptor 22 detachably attaches the compression member 20 to the base member 30 with the first compression member surface 24 adjoining the first base member surface 34. The compression member 20 is manufactured from any material known by those skilled in the art to be capable of withstanding the pressures of the separation process. Such materials include steel, ceramic, and plastic. Exemplary dimensions of the compression member 20 are a 4.88 inch diameter of the compression member aperture 23, a 5.00 inch diameter of the exterior compression member surface 26, and a thickness defined by the distance between the first compression member surface 24 and the second compression member surface 25 of 1.00 inch. One skilled in the art would know that these exemplary dimensions may vary depending on the separation machine.

Figure 4:
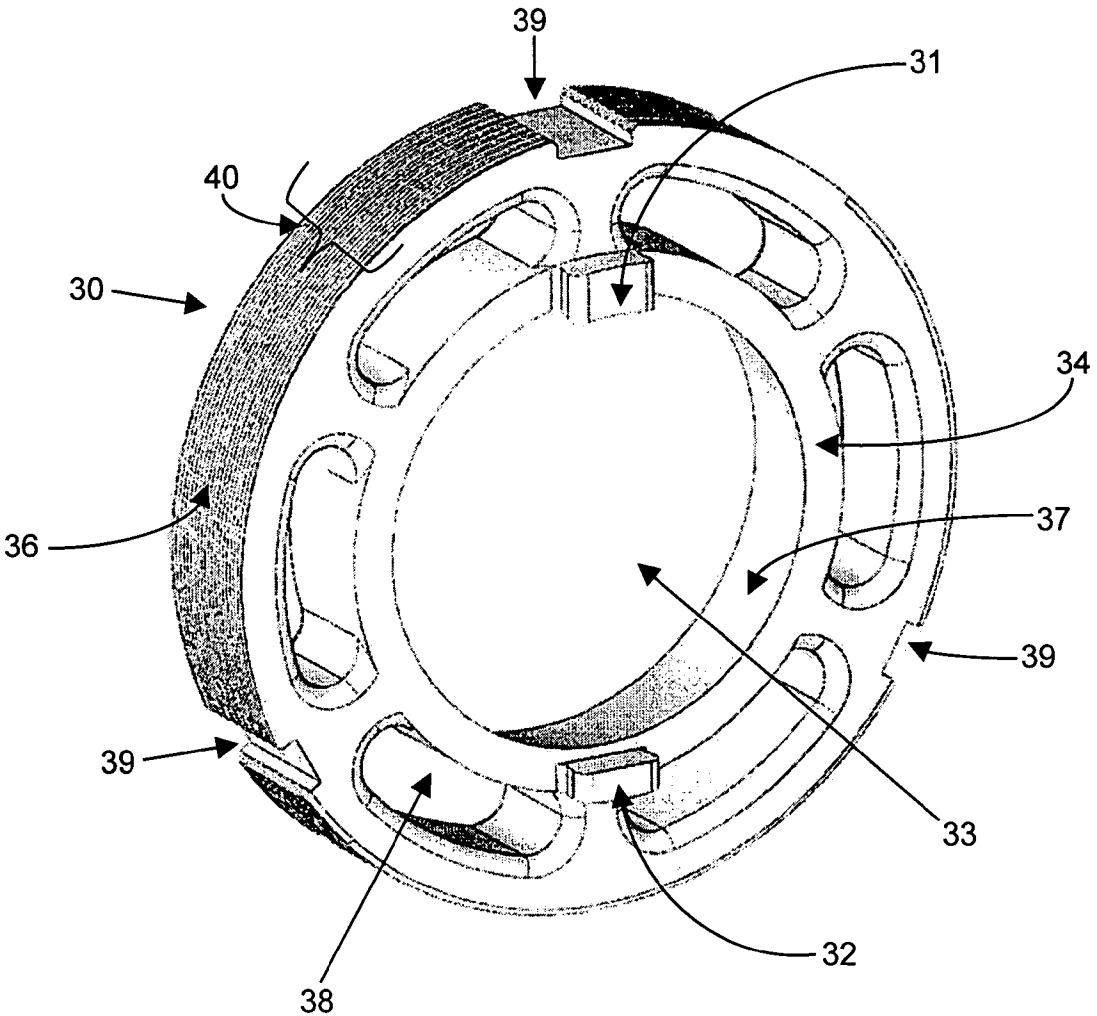
FIG. 4 shows the base member of FIG. 2 disassembled from the compression assembly of FIG. 2.

FIG. 4 shows more particularly one embodiment of a base member 30 of this invention. As shown in FIG. 4, the base member 30 is generally cylindrical in shape, having a first base member surface 34, a second base member surface (not shown) substantially parallel to the first base member surface 34 and located on the opposite side of the base member 30, an exterior base member surface 36, and an interior base member surface 37. The interior base member surface 37 defines the base member primary aperture 33, at least a portion of which aligns with at least a portion of the compression member aperture 23 when the compression member 20 is fastened to the base member 30. The primary key 31 extends from the first base member surface 34, and the secondary key 32 also extends from the first base member surface 34. The shape and orientation of the primary key 31 is complementary to the shape and orientation of the primary key receptor 21 and the shape and orientation of the secondary key 32 is complementary to the shape and orientation of the secondary key receptor 22 such that the primary key 31 fits securely within the primary key receptor 21, the secondary key 32 fits securely within the secondary key receptor 22, and the first compression member surface 24 adjoins snugly to the first base member surface 34 when the compression member 20 is attached to the base member 30, as shown in FIG. 2.

The base member 30 shown in FIG. 4 also comprises a plurality of base member secondary apertures 38 that extend from the first base member surface 34 to and through the second base member surface, this plurality of base member secondary apertures 38 being shown as located between the exterior base member surface 36 and the interior base member surface 37. This plurality of base member secondary apertures 38 permits liquid and other similar materials to flow though the base member 30 without seeping around it and thereby prevents maintenance problems that can occur as a result of such seepage around the base member 30, such as freezing the compression assembly 10 to prevent adjustment and easy removal. In FIG. 4, these base member secondary apertures 38 are shown as being circumferentially oriented around the base member 30 and shaped as extended ovals. However, one skilled in the art would know that these base member secondary apertures 38 may be of different shapes and orientations than those shown in FIG. 4. The exterior base member surface 36 may be threaded as shown by the threads 40 to permit connection of the compression assembly to the separation machine 100 (shown on FIG. 1) and adjustment of the spacing between the compression member assembly 10 and auger 104 (shown on FIG. 5), piston, or other like device.

The base member 30 shown in FIG. 4 also comprises a plurality of alignment portions 39 in the exterior base member surface 36 that are utilized to maintain the orientation of the compression assembly 10 relative to the auger 104 as the spacing between the compression assembly 10 and the auger 104 is adjusted. In FIG. 4, these alignment portions 39 are shown as grooves that are substantially perpendicular to the threads 40. However, one skilled in the art would know that other embodiments of the alignment portions 39 are possible.

The compression member 20 is detachably attached to the base member 30 by aligning the compression member 20 and the base member 30 so that the first compression member surface 24 is oriented adjacent to and against the first base member surface 34, the primary key 31 is oriented in alignment with the primary key receptor 21, and the secondary key 32 is oriented in alignment with the secondary key receptor 22. The compression member 20 and base member 30 are then shifted in such a way to cause the primary key 31 to fully engage the primary key receptor 21 and to cause the secondary key 32 to fully engage the secondary key receptor 22.

In operation, the compression member is attached to the base member, which engages a worm drive via the threads, such worm drive being used to position the compression assembly relative to an auger or similar such pressure device. The inwardly tapered opening of the compression member is positioned along the correspondingly tapered ramp of the auger so as to create an opening through which hard material may be evacuated as the soft material is forced along the conduit and through the screen. The pressure is controlled by adjusting the threads of the base to position the compression assembly relative to the auger as desired. The pressure of the hard material against the compression member as the hard material is forcibly evacuated results in wear on the compression member and necessitates maintenance and possible replacement of the compression member. At such times, the compression member is shifted relative to the base member so as to disengage the primary and secondary keys from their respective primary and secondary key receptors and thereby disassemble the compression member from the base member.

Substantial benefits result from the use of the compression assembly of the present invention. The compression assembly as described above allows for easier maintenance of the separation machine by reducing the difficulty of disassembling the compression member from the base member when the compression member needs to be re-machined or replaced. The absence of fasteners, such as nuts and bolts, that are separate from both the compression member and the base member eliminates the possibility that such fasteners will be lost and therefore reduces the time and expense of maintaining and cleaning the separation machine. Also, the compression member of the present invention allows for faster disassembly of the compression member from the base member due to the absence of separate fasteners, which otherwise must be separately and individually unfastened. In addition, the reduction in the number of openings for use in conjunction with such separate fasteners increases the structural integrity of the compression assembly by reducing the number of potential areas, e.g. bolts, or the holes through which such bolts pass, that might fracture under stress. Although the particular embodiment discussed herein discusses a specific arrangement of a single primary key and a single secondary key, one skilled in the art will appreciate that many other embodiments consistent with spirit and scope of the present invention are possible to permit attachment of the compression member to the base member without the use of separate fasteners that are independent of both the compression member and the base member.

In separation machines based on prior art, a common problem is that liquid seeps into the threaded portion of the base member. Upon drying, the liquid hardens and freezes the threads, which prevents turning of the base via the threads and thereby prevents adjustment of the position of the compression assembly. The present invention offers a substantial improvement in this regard because the base member secondary apertures allow liquid that otherwise would seep into the threaded portion of the base to pass through the assembly for evacuation. As a result, the liquid does not harden onto the threads, and the compression assembly position may be adjusted via use of the threads.

As those skilled in the art will appreciate, the particular embodiment of this invention described above and illustrated in the figures is provided for explaining the invention, and various alterations may be made in the structure and materials of the illustrated embodiment without departing from the spirit and scope of the invention as described above and defined in the following claims.

I claim:

1. A compression assembly, comprising:

(a) a compression member having a compression member aperture, wherein the compression member further comprises a first compression member surface, a second compression member surface, an exterior compression member surface, and an interior compression member surface, the first compression member surface, second compression member surface and interior compression member surface defining the compression member aperture, the interior compression member surface extending from the first compression member surface to the second compression member surface, the interior compression member surface not being substantially perpendicular to the first and second compression member surfaces;

(b) a base member having a base member primary aperture, at least a portion of the base member primary aperture aligning with at least a portion of the compression member aperture when the base member is detachably attached to the compression member; and (c) a primary key, a secondary key, a primary key receptor and a secondary key receptor, the primary key adapted to be received by the primary key receptor and the secondary key adapted to be received by the secondary key receptor wherein the interaction of the primary key with the primary key receptor and the secondary key with the secondary key receptor detachably attaches the compression member to the base member.

2. The compression member assembly of claim 1, wherein the primary key and the secondary key are not substantially identical and wherein the primary key receptor and the secondary key receptor are not substantially identical such that the secondary key cannot be received by the primary key receptor and the primary key cannot be received by the secondary key receptor.

3. The compression assembly of claim 2, wherein the primary key and the secondary key extend from the base member and the primary key receptor and secondary key receptor recess into the compression member and wherein the primary key receptor extends from the exterior compression member surface to and through the interior compression member surface and wherein the secondary key receptor extends from the exterior compression member surface toward the interior compression member surface but does not extend through the interior compression member surface.

4. The compression assembly of claim 1, wherein the base member further comprises an exterior base member surface, the exterior base member surface comprising a plurality of threads.

5. The compression assembly of claim 4, wherein the exterior base member surface further comprises a plurality of alignment portions.

6. The compression assembly of claim 5, wherein the alignment portions comprise grooves that are not substantially parallel to the plurality of threads.

7. The compression assembly of claim 1, wherein the base member further defines a plurality of base member secondary apertures, the base member secondary apertures located between an outer edge of the base member primary aperture and an outer edge of the base member.

8. The compression assembly of claim 1, wherein interaction of the primary key with the primary key receptor and interaction of the secondary key with the secondary key receptor correctly align the compression member with respect to the base member when the compression member is detachably attached to the base member.

9. A compression member, comprising:

(a) a first compression member surface, a second compression member surface and an interior compression member surface;

(b) a primary key receptor and a secondary key receptor;

(c) wherein the interior compression member surface defines a compression member aperture, wherein the interior compression member surface extends from the first compression member surface to the second compression member surface, and wherein the interior compression member surface is not substantially perpendicular to the first and second compression member surfaces; and (d) wherein the compression member is adapted to be detachably attached to a base member by a primary key, a secondary key, the primary key receptor and the secondary key receptor, the primary key of the base member adapted to be received by the primary key receptor and the secondary key of the base member adapted to be received by the secondary key receptor.

10. The compression member of claim 9, wherein the primary key receptor and secondary key receptor are formed in the first compression member surface.

11. The compression member of claim 10, wherein the primary key receptor and the secondary key receptor are not substantially identical.

12. The compression member of claim 11, wherein the primary key receptor extends from an exterior compression member surface to and through an interior compression member surface and wherein the secondary key receptor extends from the exterior compression member surface toward the interior compression member surface but does not extend through the interior compression member surface.

13. A device for separating a first material from a second material, the device comprising:

(a) a conduit;

(b) an inlet tube connected to the conduit for providing the conduit with first and second materials;

(c) a separating apparatus positioned at one end of the conduit, the apparatus comprising a wall having a plurality of apertures;

(d) a device for moving the first and second materials along the conduit form the inlet tube to the separating apparatus end of the conduit so that that the first material and a controlled amount of the second material are forced through the apertures in the apparatus; and (e) wherein the amount of the second material being forced through the apertures in the apparatus is controlled by a compression assembly, the compression assembly comprising:

(i) a compression member, the compression member having a compression member aperture;

(ii) a base member, the base member adapted to be detachably attached to the compression member, and wherein the base member defines a base member primary aperture, at least a portion of the base member primary aperture aligning with at least a portion of the compression member aperture when the base member is detachably attached to the compression member;

(iii) a primary key, a secondary key, a primary key receptor and a secondary key receptor, the primary key adapted to be received by the primary key receptor and the secondary key adapted to be received by the secondary key receptor, the interaction of the primary key with the primary key receptor and the secondary key with the secondary key receptor detachably attaching the compression member to the base member; and (iv) wherein the amount of second material forced through the apertures in the apparatus is controlled by moving the compression assembly with respect to the device for moving the first and second materials along the conduit.

14. The device for separating a first material from a second material of claim 13, wherein the base member further defines a plurality of base member secondary apertures, the base member secondary apertures located between an outer edge of the base member primary aperture and an outer edge of the base member.

* * * * *